United States Patent [19]

Humble et al.

[11] Patent Number: 5,036,443

[45] Date of Patent: Jul. 30, 1991

[54] PROXIMITY LIGHT

[76] Inventors: Wayne Humble, 294 Waterside Dr., Little Ferry, N.J. 07643; George Spector, 233 Broadway, New York, N.Y. 10007

[21] Appl. No.: 517,816

[22] Filed: May 2, 1990

[51] Int. Cl.[5] ..... F21L 9/00

[52] U.S. Cl. ..... 362/183; 362/276; 362/802; 4/661

[58] Field of Search ..... 362/96, 101, 155, 183, 362/253, 276, 394, 802, 205, 154; 4/661

[56] References Cited

U.S. PATENT DOCUMENTS

| | | | |
|---|---|---|---|
| 4,638,412 | 1/1987 | Weigert | 362/276 X |
| 4,823,241 | 4/1989 | Trattner | 362/155 X |
| 4,841,416 | 6/1989 | Doss | 362/276 X |
| 4,860,178 | 8/1989 | Picon | 362/101 |
| 4,901,461 | 2/1990 | Edwards et al. | 362/276 X |

*Primary Examiner*—Stephen F. Husar

[57] ABSTRACT

A proximity light is provided and consists of a housing adhesively mounted to a flat surface such as a wall or the underside of a toilet seat cover. An electrically operated light source is carried within the housing along with electronic circuitry for supplying electric current to energize the light source. A sensor switch is also carried within the housing and is connected between the electronic circuitry and the light source so as to close when it gets dark.

5 Claims, 1 Drawing Sheet

PROXIMITY LIGHT

BACKGROUND OF THE INVENTION

The instant invention relates generally to lights and more specifically it relates to a proximity light which provides illumination to a darkened area where the proximity light is mounted.

There are available various conventional lights which do not provide the novel improvements of the invention herein disclosed.

SUMMARY OF THE INVENTION

A primary object of the present invention is to provide a proximity light that will overcome the shortcomings of the prior art devices.

Another object is to provide a proximity light that is basically a solar rechargeable flashlight with a sensor switch which will illuminate a darkened area where the proximity light is mounted.

An additional object is to provide a proximity light that includes a gravity operated mercury switch which will close the electrical circuit when the proximity light is positioned in a vertical position when mounted on a flat surface such as on the underside of a toilet seat cover or on a wall.

A further object is to provide a proximity light that is simple and easy to use.

A still further object is to provide a proximity light that is economical in cost to manufacture.

Futher objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
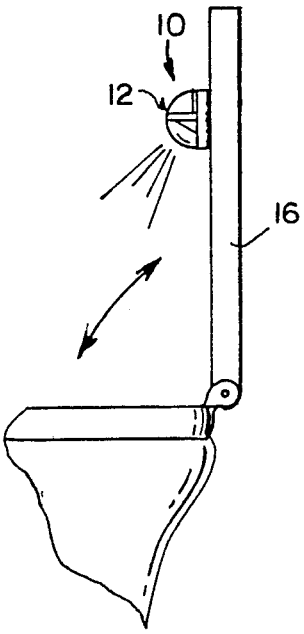
FIG. 1 is a side view of the invention installed on underside of a pivotable toilet seat cover.
Figure 2:
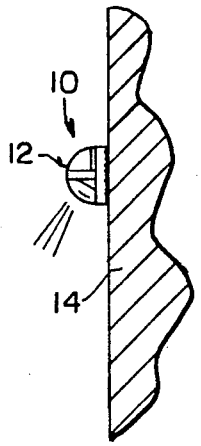
FIG. 2 is a side view of the invention installed on a flat stationary wall.
Figure 3:
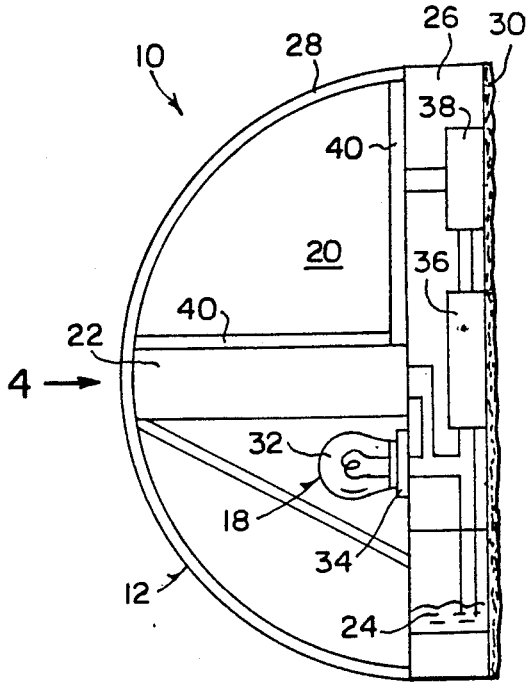
FIG. 3 is an enlarged diagrammatic side view showing the internal electrical circuit therein.
Figure 4:
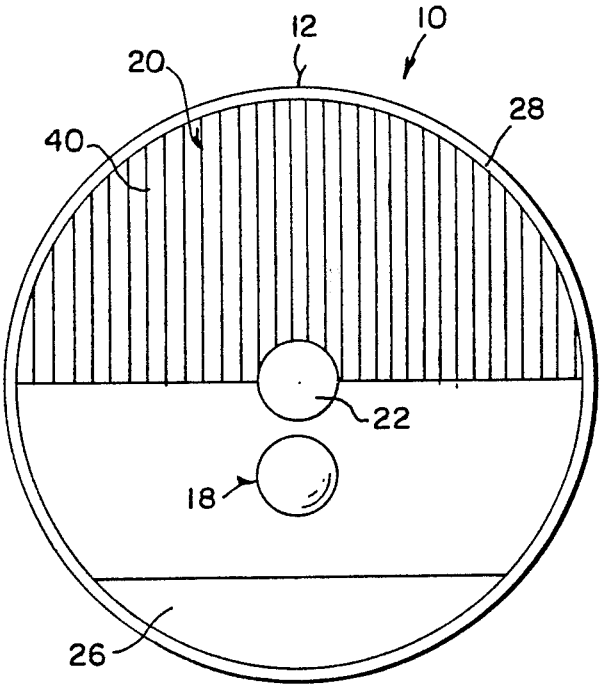
FIG. 4 is a front view taken in direction of arrow 4 in FIG. 3.
Figure 5:
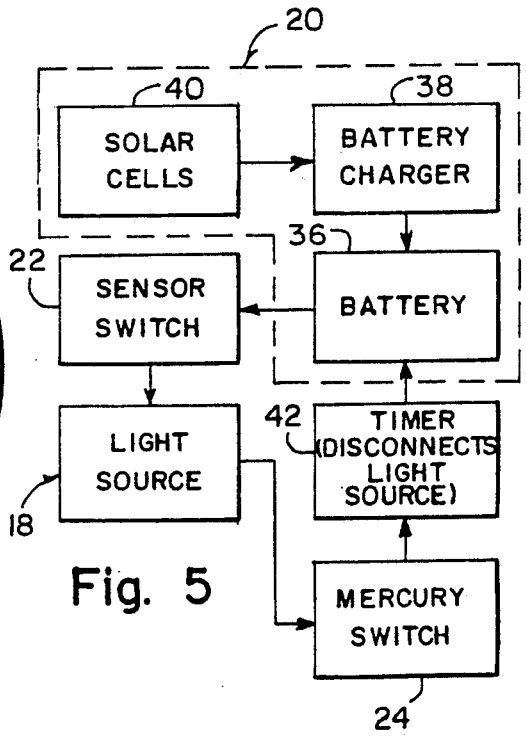
FIG. 5 is a block diagram of the electrical circuit.

Turning now descriptively to the drawings, in which similar reference characters denote similar elements throughout the several views, the Figures illustrate a proximity light 10 consisting of a housing 12 mounted to a flat surface such as a wall 14 (FIG. 2) or the underside of a toilet seat cover 16 (FIG. 1). An electrically operated light source 18 is carried within the housing 12 along with electronic circuitry 20 for supplying electric current to energize the light source 18. A sensor switch 22 is also carried within the housing 12 and is connected between the electronic circuitry 20 and the light source 18 so as to close when it gets dark. The sensor switch 22 could be a thermal, an infrared or a sonic activated type.

A gravity operated mercury switch 24 is connected between the light source 18 and the electronic circuity 20. When the housing 12 is mounted on the flat wall 14 or the underside of the toilet seat cover 16 in a vertical position, the mercury switch 24 will close.

The housing 12 includes a base member 26 with a transparent dome shaped cover 28 with a layer of adhesive material 30 on the back of the base member 26 so as to be mounted to the flat surface. The light source 18 includes an electric lamp 32 contained within a socket 34.

The electronic circuitry 20 includes a battery 36 for supplying the electric current to the socket 34 with the electric lamp 32. A battery charger 38 is connected to the battery 36. Solar cells 40 are connected to the battery charger 38 for operating the battery charger to recharge the battery 36.

To use the proximity light 10 on the wall 14, simply mount the base member 26 with the adhesive material 30 thereto. The mercury switch 24 will close whereby the electric lamp 32 will be energized by the operation of the sensor switch.

To use proximity light 10 on the underside of the toilet seat cover 16, simply mount the base member 26 with the adhesive material 30 thereto. When the toilet seat cover 16 is placed in its vertical position, the mercury switch 24 will close whereby the electric lamp 32 will be energized by the operation of the sensor switch.

When a person steps up to the proximity light 10, the sensor switch 22 will detect the person and then check to see if it is light or dark thereabout. If it is dark, the electric lamp 32 will be activated until the person leaves the area.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A proximity light comprising:

(a) a housing;

(b) means for mounting said housing to a flat surface;

(c) an electrically operated light source carried within said housing;

(d) means carried within said housing, for supplying electric current to energize said light source; and (e) a sensor switch carried within said housing and connected between said supplying means and said light source so as to close when it gets dark; further including a gravity operated mercury switch connected between said light source and said supplying means so that when said housing is mounted on the flat surface in a vertical position, said mercury switch will close.

2. A proximity light as recited in claim 1, wherein said housing includes a base member with a transparent cover.

3. A proximity light as recited in claim 2, wherein said mounting means in a layer of adhesive material between the back of said base member and the flat surface.

4. A proximity light as recited in claim 3, wherein said light source includes an electric lamp contained within a socket .

5. A proximity light as recited in claim 4, wherein said supplying means includes:

(a) a battery for supplying the electric current to said socket with said electric lamp;

(b) a battery charger connected to said battery; and (c) solar cells connected to said battery charger for operating said battery charger to recharge said battery.

* * * * *